US006431342B1

(12) United States Patent
Schwartz

(10) Patent No.: US 6,431,342 B1
(45) Date of Patent: Aug. 13, 2002

(54) OBJECT ROUTING SYSTEM

(76) Inventor: Andrew Schwartz, 910 Samantha Cir., Chester Springs, PA (US) 19425

( * ) Notice: Subject to any disclaimer, the term of this patent is extended or adjusted under 35 U.S.C. 154(b) by 0 days.

(21) Appl. No.: 09/394,622

(22) Filed: Sep. 13, 1999

(51) Int. Cl.[7] ..... G07D 3/14
(52) U.S. Cl. ..... 194/346; 453/3
(58) Field of Search ..... 194/346; 453/3, 453/4, 7, 11

(56) References Cited

U.S. PATENT DOCUMENTS 3,045,864 A 7/1962 Hurst et al. ..... 221/7
3,290,488 A 12/1966 Sewell
3,722,674 A * 3/1973 Hoppmann et al. ..... 221/7
4,167,949 A 9/1979 Hashimoto et al.
4,261,377 A 4/1981 Ueda
4,360,034 A 11/1982 Davila et al.
4,396,029 A 8/1983 Anderson
4,444,212 A 4/1984 Ristvedt et al.
4,466,453 A 8/1984 Said et al.
4,558,711 A * 12/1985 Ikuta-Yoshiaki et al. ..... 453/3
4,657,035 A 4/1987 Zimmermann
4,681,128 A 7/1987 Ristvedt et al.
4,681,204 A 7/1987 Zimmermann
4,731,043 A 3/1988 Ristvedt et al.
4,822,318 A 4/1989 Okada
4,836,825 A 6/1989 Smeets et al.
4,966,570 A 10/1990 Ristvedt et al.
5,055,086 A 10/1991 Raterman et al.
5,082,141 A * 1/1992 Martin et al. ..... 221/278
5,123,873 A 6/1992 Rasmussen
5,135,433 A * 8/1992 Watanabe et al. ..... 453/3
5,139,130 A * 8/1992 Boxall ..... 194/346
5,382,191 A 1/1995 Rasmussen
5,425,669 A 6/1995 Geib et al.
5,429,550 A 7/1995 Mazur et al.
5,453,047 A 9/1995 Mazur et al.
5,474,496 A 12/1995 Perkitny
5,480,348 A 1/1996 Mazur et al.
5,489,237 A 2/1996 Geib et al.
5,496,212 A * 3/1996 Meyer-Weingartner et al. .. 194/346 X
5,538,468 A 7/1996 Ristvedt et al.
5,564,978 A 10/1996 Jones et al.
5,584,758 A 12/1996 Geib
5,607,351 A * 3/1997 Schwartz ..... 453/32
5,624,308 A 4/1997 Rumbach ..... 453/3
5,676,234 A 10/1997 Smith et al.
5,810,174 A * 9/1998 Hamada et al. ..... 209/584
5,830,054 A 11/1998 Petri
5,910,044 A 6/1999 Luciano, Jr. et al.
6,039,166 A * 3/2000 Abe et al. ..... 194/317
6,080,056 A * 6/2000 Karlsson ..... 453/3

FOREIGN PATENT DOCUMENTS

JP 5-2680 * 1/1993 ..... 453/3

* cited by examiner

*Primary Examiner*—F. J. Bartuska
(74) *Attorney, Agent, or Firm*—Blank Rome Comisky & McCauley LLP

(57) ABSTRACT

An object routing system includes a sensor, a processor and a guide. The sensor detects a characteristic of an object and generates a signal that indicates that characteristic. The processor receives the signal from the sensor and generates a guide control signal based upon the signal from the sensor. The guide is responsive to the guide control signal to route the object. The processor can be programmed to control the guides to route the objects in any desired manner.

4 Claims, 7 Drawing Sheets

OBJECT ROUTING SYSTEM

BACKGROUND OF THE INVENTION

1. Field of Invention

The present invention relates to object routing systems. More particularly, the present invention relates to an object routing system that provides a flexible routing capability and which includes a sensor and a guide placed in a path of an object.

2. Description of Related Art

The task of counting and sorting aggregations of objects is quite arduous in the day to day operation of those industries where object handling is paramount such as banks, toll booths, casinos, pharmacies, post offices, factories and the like. The problem that arises, however, is that generally before most objects can be counted at high speed the objects must first be separated and sorted. Sorting is a very important step in such object handling processes known in the art and generally creates the highest percentage of service problems for the aforementioned industries among others. For example, if an incorrect sort occurs, the result is an inaccurate count.

Obviously, such inaccuracies produce accounting errors of inventory. In the case of coin counting, such errors in currency exchanges with the respective institutions' customers result in somebody getting cheated. Additional problems arise in the coin counting arena if the customer feels that the value assigned is incorrect and wishes a recount or verification. In this case, the coins have already been sorted and in most cases commingled with other aggregations. Therefore, any attempt to verify the value or re-count the coins requires an extremely difficult and time consuming procedure which shuts down the machine for quite some time.

Many devices exist in the art for sorting coins using a rotating disk type mechanism. Most employ a rotatable lower disk which has a stationary upper disk superimposed thereon with guides of various widths that sort coins according to their respective size, weight or diameter. U.S. Pat. No. 4,543,969 to Rasmussen discloses a coin sorter apparatus comprised of a rotating disk located proximate a stationary disk. The coins are moved between the two disks wherein a series of ridges and recesses sorts the mixed denomination of coins through peripherally located spaces that exit the coin, thereby sorting it according to its thickness. U.S. Pat. No. 4,775,354 also to Rasmussen sorts the coins in a similar fashion using a rotating disk assembly that separates them according to their diameter.

U.S. Pat. No. 4,570,655 to Raterman teaches a coin sorting apparatus similar to that of Rasmissen utilizing the rotating disk assembly with grooved surfaces for transporting coins in outward radial directions according to their size. Exit recesses equidistant from each other about the periphery of the disk provide a means to separate and sort the coins. A sensory device is located by each recess which, when a pre-determined number of coins are sorted, automatically signals a bridge guide and a diameter guide which redirect the rotating coins and terminate the sorting process for each respective denomination. U.S. Pat. No. 4,564,036 to Risvedt discloses a similar apparatus whereby sensors count coins separated according to size and when a predetermined number is sorted the remaining coins are redirected back to the center of the disk.

U.S. Pat. No. 4,921,463 to Primdahl et. al. discloses a rotating disk assembly wherein the coins are sorted as they are ejected through equidistantly-spaced recesses in the periphery of the lower disk which are counted by a sensor. Once a predetermined number is reached, a brake mechanism is operatively connected to the sensor through an electromagnetic actuating assembly and shuts the sorting process off when that number of coins is sorted. U.S. Pat. Nos. 4,098,280 and 4,444,212 both to Risvedt et. al. disclose rotating disk assemblies with a flexible surface and an annular guide plate suspension thereon to direct radially moving coins towards the periphery. Counters calibrated to the denomination at each exit allow for the determination of the number of coins of each denomination. U.S. Pat. Nos. 4,531,531 and 4,549,561 to Johnson et. al. discloses a coin sorting apparatus comprising a rotating disk which, like the rest of the prior art, separates the coins using grooves and recesses which direct the coins in their radial movement outward due to centrifugal force to designated exit portals which sort them according to size. Coin counters may be of the type employing light, radiation, magnetic or other forms of conventional sensing devices to verify each different sized coin. The coins move single file about the periphery until each one exits through an appropriately sized recess.

U.S. Pat. No. 5,607,351 to Schwartz discloses a coin counting machine. The coin counting machine can count large, multi-denominational aggregations of coins at high speeds. U.S. Pat. No. 5,607,351 is assigned to Automated Currency Instruments which is the same assignee of the present application. U.S. Pat. No. 5,607,351 also has the same inventor as the present application. U.S. Pat. No. 5,607,351 is incorporated by reference herein in its entirety.

SUMMARY OF THE INVENTION

The above-described systems are limited in the ability to process objects. By contrast, the present invention is an object routing system with a flexible routing capability. The system routes objects for any number of different purposes such as distributing, sorting, diverting, counting and the like. The present invention routes objects in a high speed stream of objects with a guide. The guide is controlled based upon a signal from a sensor that indicates a characteristic of the object. The guide is controlled based upon the signal from the sensor to route the object.

In an exemplary embodiment of an object routing system in accordance with the present invention the guide is controlled with a bidirectional motor such as a stepper motor and the like. A bi-directional motor has a small inertia and, as a result, has a fast response time. Thus, this embodiment is particularly useful for high speed routing of objects. This small inertia also contributes to the low amount of power that is required by the motor. Additionally, the bi-directional motor may be actuated to varying positions or levels. For example, the bi-directional motor may be controlled to position the associated guide between more than two positions. In comparison, a solenoid can only be positioned in two positions. The motor is also bidirectional in the sense that it can be driven in two directions. By contrast, a solenoid can also drive a guide in accordance with the present invention but a solenoid can only be driven in a single direction.

The present invention can route many different types of objects. For example, the present invention may route coins, small parts, feed, grain, pills, mail and the like. In general, the present invention is useful for routing most any type of object based upon the characteristics of each of those objects. Additionally, the present invention provides the capability of routing these objects in accordance with any given desired manner.

One exemplary embodiment of an object routing system in accordance with the present invention is a coin/token routing system that permits fast and accurate routing of a mixed aggregate of multi-denominational coins. A rotating disk containing integral radial channels centrifugally moves the coins from a centrally located coin deposit tray outward until the coins pass a sensor that determines the type of coin and through a guide that controls the route of the coin in accordance with the coin type. The sensor determines the coin type and/or count and generates a signal. A processor receives the sensor signal and controls the guide based upon the sensor signal.

The coin/token routing system includes a processor that can be programmed to control the guides to route the coins in any desired manner. For example, the processor may be programmed to control the guides to collect batches of coins that include five dollars worth of quarters and two dollars worth of dimes into each batch and to segregate all other coins into a single batch. The processor would keep track of the type of coins and the number of each type of coins and control the guides to direct the appropriate amount into each batch.

Other simpler examples include, a processor that is programmed to separate different types of coins into batches, to simply count coins or to allow a stream of coins to flow into a single batch until a predetermined value is achieved. The object routing system may route objects in accordance with any set of rules based upon the characteristics of the objects.

The object routing system is also useful in the pharmaceutical industry. For example, the object routing system may be programmed to receive a number of different types of pills and then route the pills into batches that correspond to doses. More specifically, the object routing system in accordance with the present invention may be programmed to collect a predetermined number of pills in accordance with the type of pills into each batch to generate a self contained dosage prescription. In this manner, personalized prescriptions may be filled with batches of pills to avoid confusion and/or mistakes being made in the dosages received by a patient. The object routing system in accordance with the present invention is also useful to generate batches of vitamins and minerals.

BRIEF DESCRIPTION OF THE DRAWINGS

Exemplary embodiments of this invention will be described in detail, with reference to the following figures, wherein.

These and other features and advantages of this invention are described in or are apparent from the following detailed description of exemplary embodiments.

DETAILED DESCRIPTION OF PREFERRED EMBODIMENTS

Figure 1:
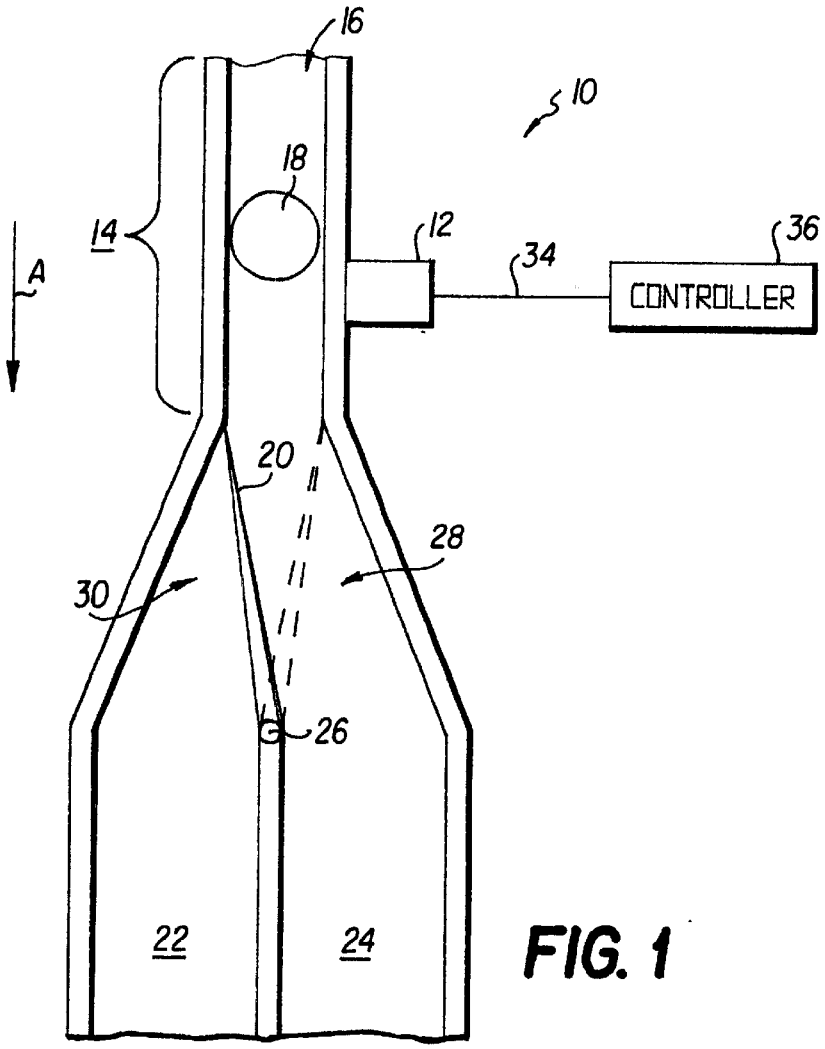
FIG. 1 is a schematic view of an exemplary embodiment of an object routing system in accordance with the present invention.

FIG. 1 is a schematic view of an exemplary embodiment of an object routing system 10 in accordance with the present invention. The object routing system 10 includes a sensor 12 that is placed adjacent a first portion 14 of a path 16 for an object 18. A guide 20 is positioned downstream of the sensor 12. The position of the guide 20 determines which of a left second portion 22 and a right second portion 24 of the path 16 through which the object will pass. The position of the guide 20 is controlled by a motor (not shown). The guide 20 rotates about a hinge 26 between a first position 28 and a second position 30 (shown in phantom).

The object 18 passes through the path 16 in the direction shown by arrow A. The object 18 may be driven through the path 16 by gravity or other means, may have acquired momentum from a driving mechanism such that the object 18 continues to pass through the path 16, may be positively driven or the like. As the object 18 passes the sensor 12, the sensor senses the object 18 in the path 16 and generates a signal 32. The signal 32 is transmitted across communication line 34 to a controller 36. The controller 36 controls the motor (not shown) based upon the signal 32 from the sensor.

As shown in FIG. 1, the first position 28 of the guide 20 causes the object 18 to move through the left second portion 22 of the path 16. The second position 30 of the guide 20, shown in phantom, causes the object 18 to move through the right second portion 24 of the path 16. In this manner, the position of the guide 20 determines through which of the second portions, 22 or 24, the object 18 will pass.

The sensor 12 may be any type of sensor that is known or has yet to be developed that can sense an object 18. The sensor 12 can sense a characteristic of the object 18. A characteristic is any feature of an object that distinguishes that object from other objects. Exemplary characteristics include size, dimension, weight, mass, color, reflectance, composition or the like. The sensor 12 may be a photoelectric sensor, a metal detector, an inductive sensor, a proximity sensor, a proximity switch, a color detector, a gray scale detector, a laser sensor, an ultrasonic sensor or the like. In general, the sensor senses a characteristic of an object 18 and the controller 36 controls the guide 20 based upon the sensed characteristic.

Figure 2:
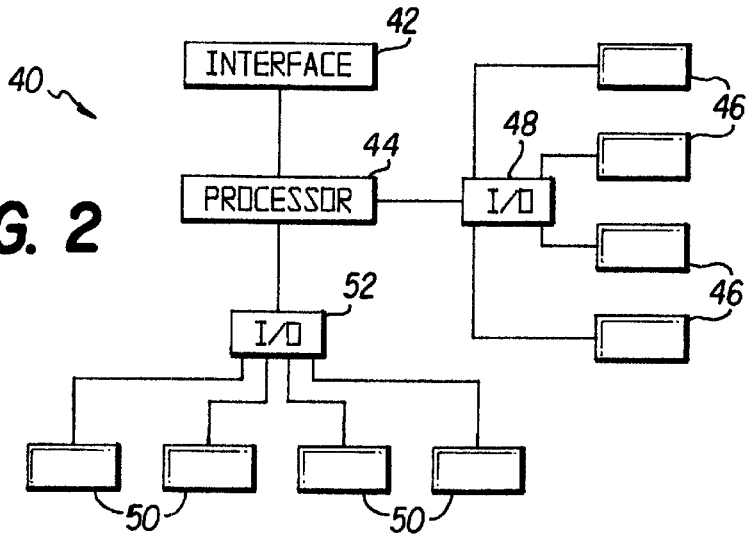
FIG. 2 is a block diagram of another exemplary embodiment of an object routing system in accordance with the present invention.

FIG. 2 is a block diagram of another exemplary embodiment of an object routing system 40 in accordance with the present invention. The object routing system 40 includes an interface 42, a processor 44, a plurality of sensors 46, an I/O device 48 for the sensors 46, a plurality of guides 50 and an I/O device 52 for the guides 50. Each of the plurality of guides 50 has a corresponding sensor 46. As explained above, each of the sensors 46 generates a signal that represents a characteristic of an object in a path that corresponds to the sensor 46. That signal is received by the processor 44 and the processor 44 generates a control signal based upon the signal from the sensor 46. The control signal is transmitted to the guide 50 that corresponds to the sensor 46. The control signal controls the position of the guide 50 to route the object that was sensed by the corresponding sensor 46.

The system 40 may be implemented using a programmed computer. However, the system 40 can also be implemented using a programmed microprocessor or micro controller and any necessary peripheral integrated circuit elements, an ASIC or other integrated circuit, a hardwired electronic or logic circuit such as a discrete element circuit, a programmable logic device such as a PLD, PLA, FPGA or PAL, or the like.

The interface 42 is used to control the object routing system 40 and/or to program the processor 44. For example, the interface 42 may be used by an operator to program the processor 44 with desired rules to follow when interpreting signals from the sensors 46 and when controlling the guides 50. The interface 42 can be implemented using any combination of a display, a keyboard, a mouse, a pen, and the like to control the object routing system 40 and/or to program the processor 44.

Another exemplary embodiment of the object routing system in accordance with the present invention is a coin routing system as shown in FIGS. 3–6. The coin routing system enables one to quickly route a mixed assortment of coins into batches and/or count the coins. In general, the coin routing system includes a rotating disk assembly, a sensor operatively attached thereto, a microprocessor logic control unit for assimilation and analysis of the data from the sensor and at least one deposit bin (not shown) for eventual collection and storage of the routed coins. Each multi-denomination or single denominational aggregate of coins that is routed may be packaged and marked to indicate their contents using a bar coding device (not shown).

The rotating disk assembly 64 includes one lower disk 72 with a centrally disposed coin deposit tray 74 a motorized drive shaft 76 and equally spaced grooves or channels 78 that are partially grooved or recessed into the upper surface of the lower disk 72 and are approximately two (2) inches wide and one-eighth (⅛) of an inch deep. What is important is that the equally spaced, equally sized grooves are large enough to accommodate the largest denomination of coined currency such as five dollar piece used in gaming establishments. The grooves 78 extend outwardly from the space 80 formed within the coin deposit tray 74 through slots 82 in the walls of the tray 74. A motor (not shown) is attached to the drive shaft 76 and is positioned above the rotating disk assembly 64. The motor rotates the disk so that the coins are centrifugally forced out of the coin deposit tray 74 through the slots 82 in single file in an outward direction (arrow B) down the grooves 78 to be sensed by a sensor device (not shown).

Figure 5:
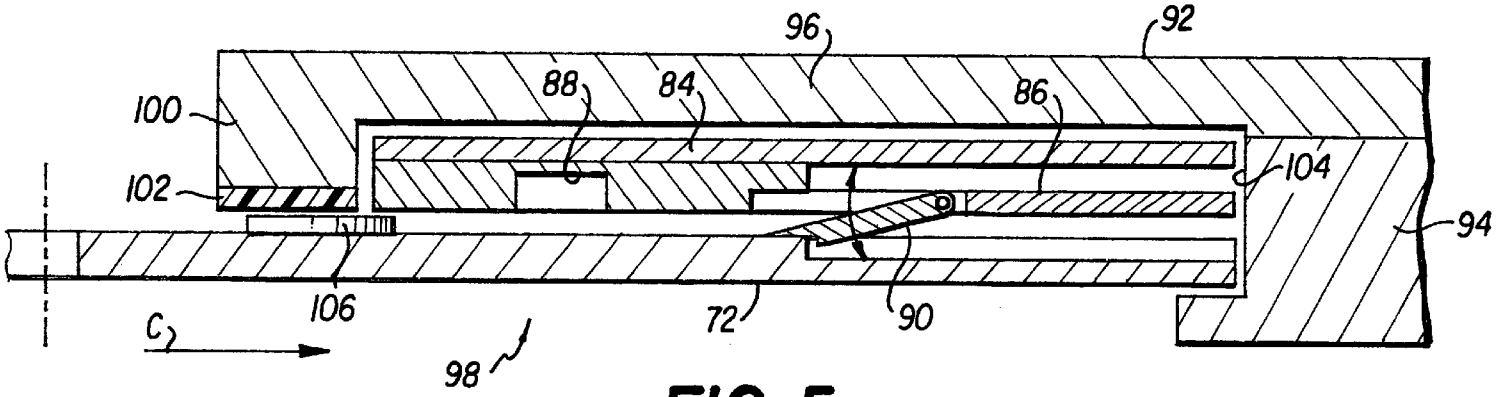
FIG. 5 is a cross-sectional view of the rotating disk assembly of FIG. 3 taken along line V—V.
Figure 3:
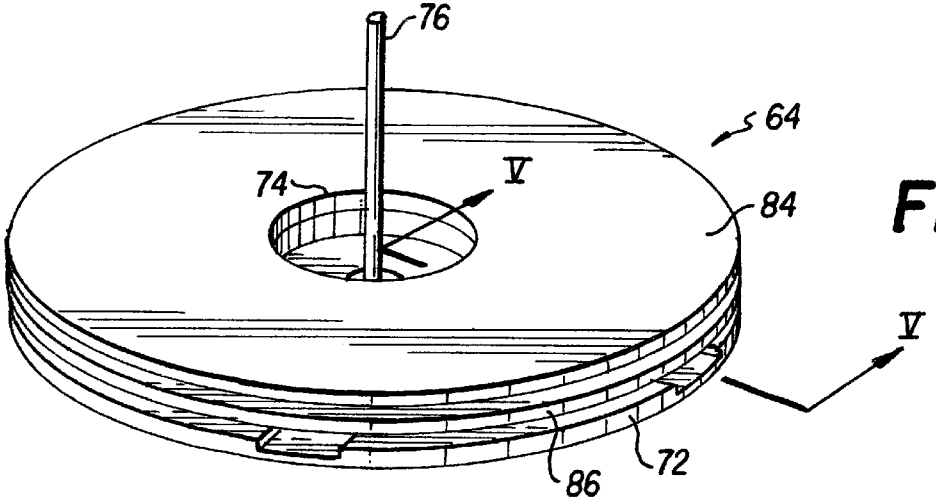
FIG. 3. is a perspective view of a rotating disk assembly of a coin routing system in accordance with the present invention.
Figure 4:
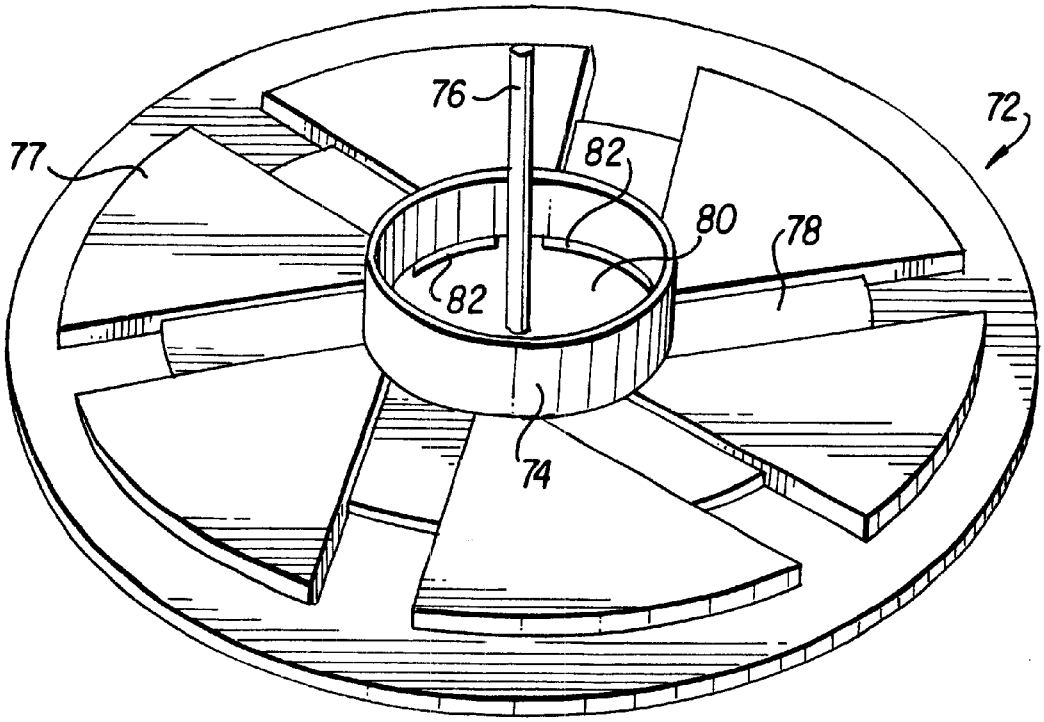
FIG. 4 is a perspective view of a grooved lower disk of the rotating disk assembly of FIG. 3.
Figure 6:
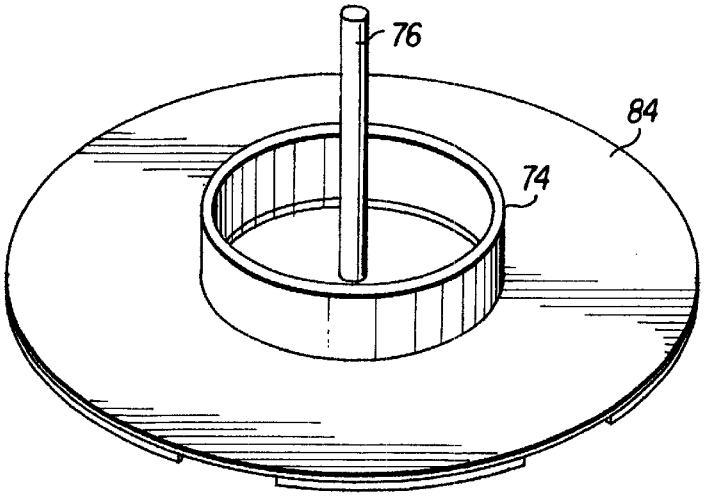
FIG. 6 is a perspective view of an upper disk of the rotating disk assembly of FIG. 3.

FIG. 5 is a cross-sectional view of the rotating disk assembly 64 of FIG. 3 taken along line V—V. As shown in FIG. 6, an upper disk 84 includes a sensor 88 and an intermediate annular ring includes a guide 90. A stationary cover 92 includes an outer circumferential ring 94 and a top portion 96. The top portion 96 extends radially in toward the center of the rotating disk assembly 98. The outer circumferential ring 94 may be made from a low friction material such as polyethylene or the like that enables the coins to contact the inner surface 104 of the outer circumferential ring 94 without being subject to substantial frictional forces. The top portion 96 has an inner portion 100 that projects down toward the lower disk 72. The lower extent of the inner portion 100 has friction material 102. The friction material 102 applies friction to the upper surface of coins as the pass below the material 102 on the lower disk 72. The friction material 102 serves to separate the top coin of a coin stack so that only a stream of single coins passes the friction material 102.

As shown in FIG. 5, a coin 106 travels in the direction shown by arrow C from the coin deposit tray 74 through slots 82 and into grooves 78. The coin 106 brushes past friction material 102 and past sensor 88. The sensor 88 generates a signal that indicates the presence and/or a characteristic of the coin 106. A processor (not shown) then controls the guide 90 based upon the signal from the sensor 88. The processor can control the guide 90 to be in the down position as shown in FIG. 5 so that the coin 106 ramps up onto the top surface of the intermediate annular ring 86 or the processor can control the guide 90 to be in the up position (shown in phantom) so that the coin 106 continues outward on the top surface of the lower disk 72.

During operation, the coins that are dumped into the coin deposit tray 74 are urged outwards against the wall of the tray due to centrifugal forces exerted against them from the spinning motion of the disk assembly 98 when the motor (not shown) attached to the drive shaft 76 is turned on. The constant revolution of the disk assembly 98 continually move the coins about in the coin deposit tray 74 and result in the eventual placement of each coin at the entrance of one of the slots 82. Continued exertion of the centrifugal forces brought about by the rotating disk assembly 98 push and route the coins in an outward radially extending movement through the sensor system and guide system. The grooved disk design with the definitive grooves or the symmetrically arranged wedges which form the passageways ensures that the coins will move in a predetermined direction in a single file manner so that each coin will pass a sensor 88 and a guide 90.

Figure 7:
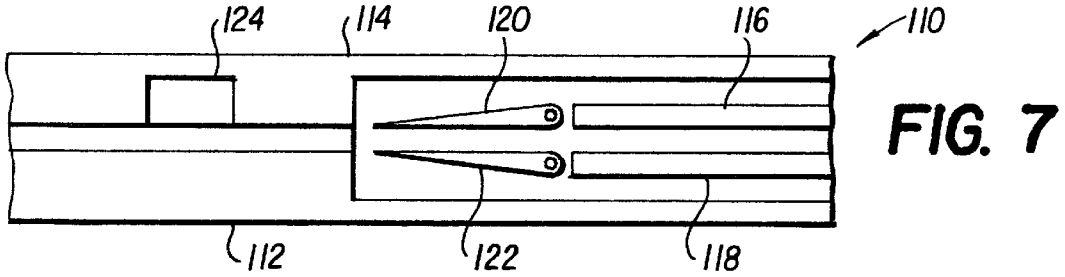
FIG. 7 is cross-sectional view of another exemplary embodiment of a rotating disk assembly in accordance with the present invention.

In operation, the guides 120 and 122 of the rotating disk assembly 110 may be controlled to be in any one of three positions to route a coin or coins to a desired level. For example, FIG. 7 shows each of the guides 120 and 122 in a centered position. In the centered position, coins are routed between the first intermediate annular ring 116 and the second intermediate annular ring 118. The guides 120 and 122 may also be positioned in an upward position to cause coins to be routed between the second intermediate annular ring 118 and the lower disk 112. Lastly, the guides 120 and 122 may be positioned in a downward position to cause coins to be routed between the first intermediate annular ring 116 and the upper disk 114.

In an alternative exemplary embodiment, a rotating disk assembly can comprise a solid lower disk 72 with no grooves but with equally sized and spaced pie-shaped wedges 125 superimposed thereon. The wedges 125 correspond to the top surface 77 of the lower disk 72 in FIG. 5 and the placement of the wedges 125 forms passageways or channels for the coins deposited in the coin deposit tray 74 to be moved radially outward through the application of centrifugal force by spinning the rotating disk assembly. In this embodiment, it is preferred that the outer edges of the wedges 125 extend beyond that of the lower disk 72 an in between the intermediate annular ring 86.

Figure 8:
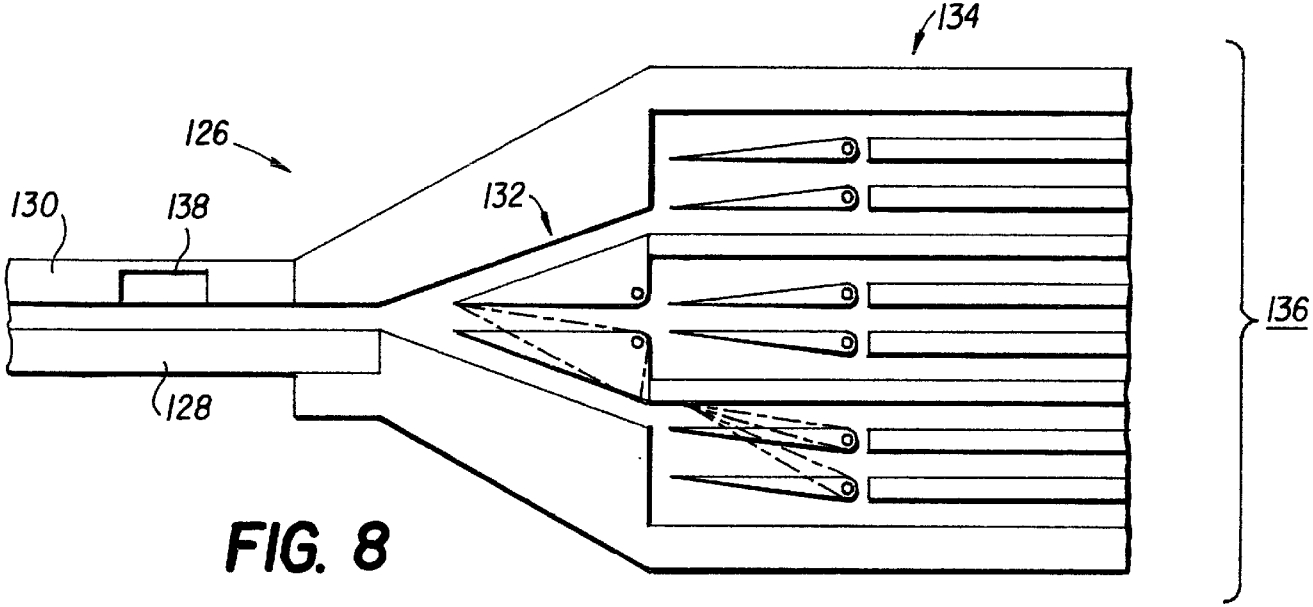
FIG. 8 is cross-sectional view of yet another exemplary embodiment of a rotating disk assembly in accordance with the present invention.

FIG. 8 shows yet another exemplary embodiment of a rotating disk assembly 126 for a coin routing system in accordance with the present invention. The rotating disk assembly 126 has a lower disk 128, an upper disk 130, a sensor 138, a first guide system 132, a second guide system 134 and a plurality of intermediate annular rings 136. The first guide system 132 is controlled to perform a first routing and the second guide system 134 performs a second routing. In the exemplary embodiment shown in FIG. 8, the first guide system 132 includes two guides, although it is to be appreciated that the first guide system 132 may include any number of guides. Similarly, the second guide system 134 may also include any number of guides. The first routing by the first guide system 132 determines which guide of the second set of guides 134 will further route the coin. In the exemplarly embodiment shown in FIG. 8, the second routing determines which of nine levels that are defined by the plurality of intermediate annular rings 136 that a coin will be routed. It is understood by one of ordinary skill in art from this description that a rotating disk assembly in accordance with the present invention may be designed with any number of levels.

In operation, the rotating disk assembly 126 receives a coin (not shown) and the coin passes the sensor 138. The sensor 138 generates a signal that indicates a characteristic of the coin. A processor (not shown) receives the signal and controls both the first guide system 132 and the second guide system 134 to route the coin based upon the signal from the sensor 138.

Figure 9:
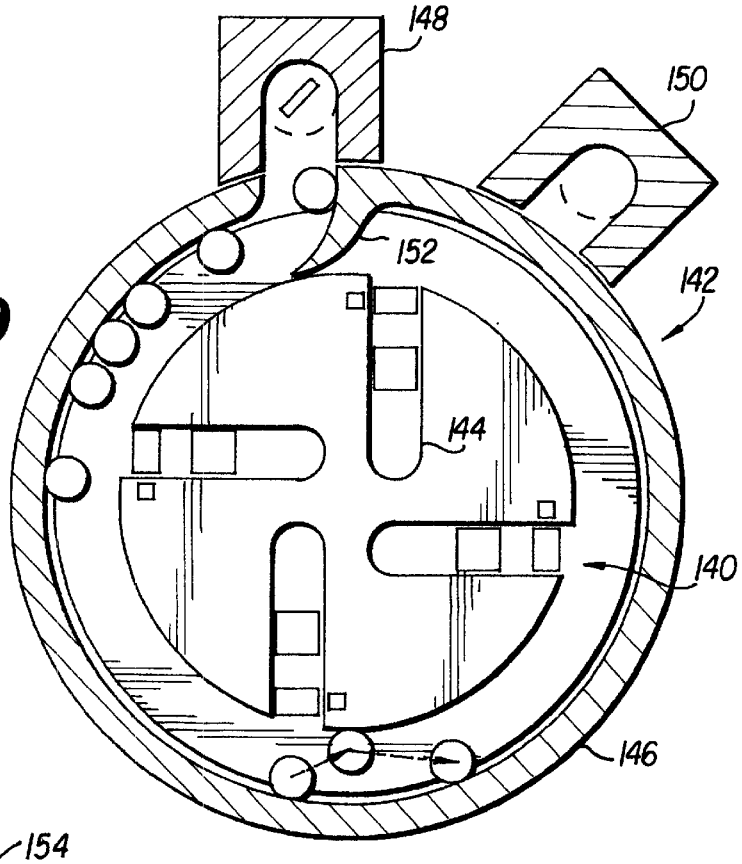
FIG. 9 is a cross-sectional view of another exemplary embodiment of a rotating disk assembly and a coin receiver assembly in accordance with the present invention.

FIG. 9 shows another exemplary embodiment of a rotating disk assembly 140 and a coin receiver assembly 142 in accordance with the present invention. The rotating disk assembly 140 is similar in construction to the rotating disk assemblies shown in FIGS. 3–8. However, the rotating disk assembly 140 has grooves 144 that are offset from and run parallel to a radial direction. The coin receiver assembly 142 includes an outer circumferential ring 146 and two coin receivers 148 and 150. The outer circumferential ring 146 includes a comb 152 for the first level and a comb (not shown) for the second level. The combs route the coins from their respective levels into corresponding coin receivers 148 or 150. As shown in FIG. 9, coins may be routed into a level from any and/or all of the grooves 144.

Figure 10:
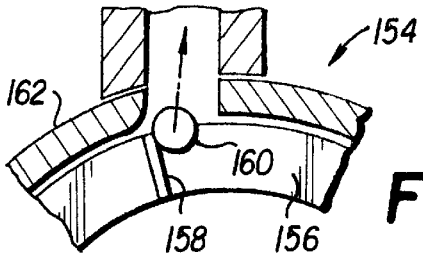
FIG. 10 is a detail view of a modification of the rotating disk assembly and coin receiver assembly of FIG. 9 in accordance with the present invention.

FIG. 10 shows a modification of an exemplary embodiment of a coin routing system in accordance with the present invention. A rotating disk assembly 154 may include an intermediate annular ring 156 with edges or protrusions 158 fixed its upper face. The edges 158 operate to further guide the coins 160 toward the corresponding coin receiver (not shown). The edges 158 may also be formed on an upper face of a lower disk (not shown). The outer circumferential ring 162 shown in FIG. 10 does not include a comb. Rather, the exemplary embodiment shown in FIG. 10 relies upon centrifugal force to move the coins 160 into the coin receiver.

Figure 11:
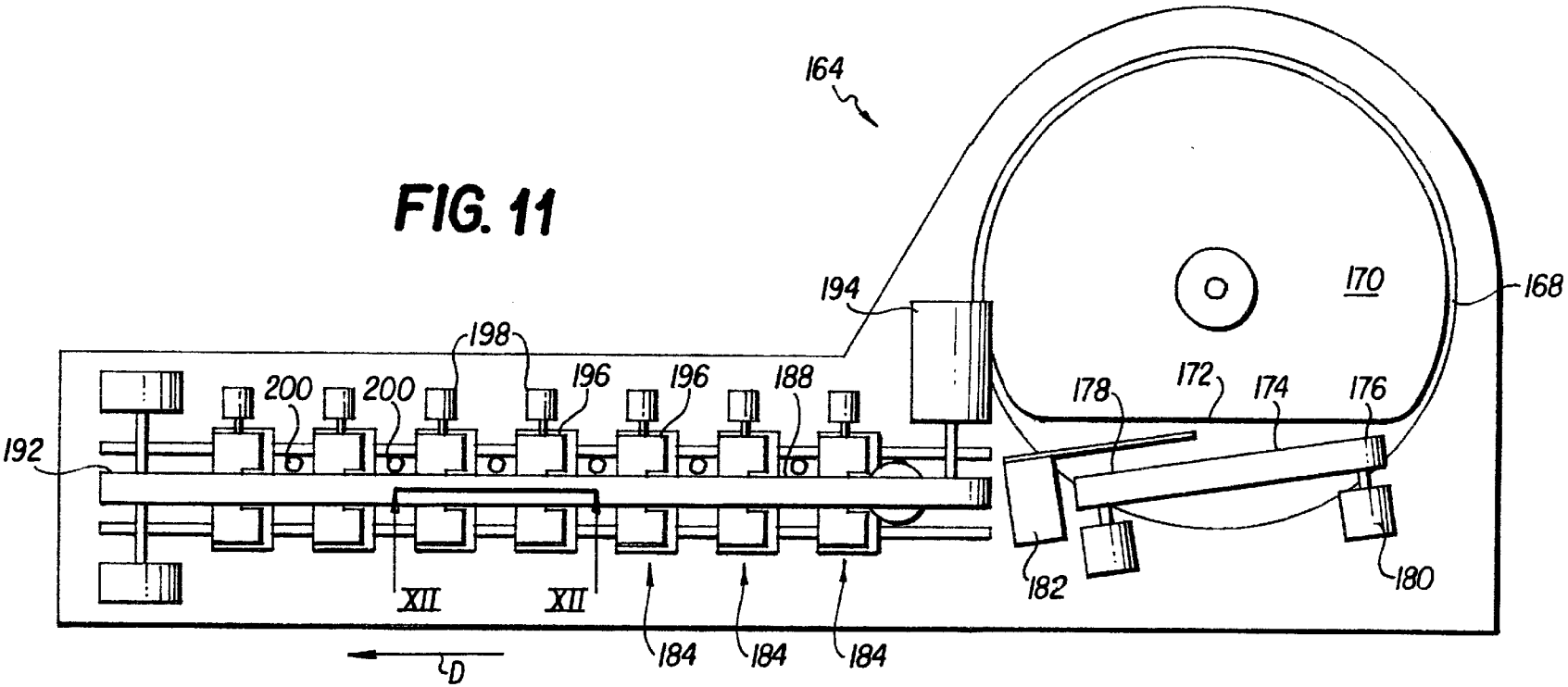
FIG. 11 shows a plan view of another exemplary embodiment of an object routing system that is adapted to route coins in accordance with the present invention.

FIG. 11 shows another exemplary embodiment of an object routing system in accordance with the present invention. In particular, FIG. 11 shows an object routing system that is a coin routing system 164. The coin routing system 164 includes a rotating disk 170 and a rough height fence 172 within a containment wall 168 of the frame of the coin routing system 164. Coins (not shown) are deposited upon the rotating disk 170 which rotates clockwise. The rough height fence 172 prevents coins that exceed a predetermined thickness from reaching a belt 174. The belt 174 extends between a drive pulley 176 and an idler pulley 178. A motor 180 drives the drive pulley 176 at a speed that is higher than the speed of the underlying surface of the rotating disk 170. Because the belt 174 moves at a speed that is higher than the surface of the rotating disk 170, stacked coins are separated. The belt 174 also removes coins from the surface of rotating disk 170 onto a rail 186 and drives the coins past a sensor 182.

The sensor 182 senses each coin as it passes and generates a signal that indicates a characteristic of the coin. A second belt 188 receives the coins as they pass the sensor 182. The second belt 188 holds the coins to the surface of the rail 186 and drives the coins along the rail 186 in the direction indicated by the arrow D. The second belt 188 extends about a drive pulley 190 and an idler pulley 192. A second motor 194 drives the drive pulley 190 which, in turn, drives the belt 188.

An array of guides 184 is positioned along the rail 186. Each of the guides 184 includes a pivoting U-shaped plate 196 connected to a guide motor 198. Each guide motor 198 communicates with a processor (not shown) to receive operational commands. Based upon these commands, the guide motor 198 pivots the corresponding U-shaped plate 196 upward or downward. The rail 186 also includes an array of sensors 200. Each of the sensors 200 generates a signal that indicates whether a coin is present and sends that signal to the processor. The processor receives the signals from the sensor 182 and from the array of sensors 200 and generates control signals to operate the array of guides 184.

Unlike conventional coin sorting systems that have a rail, the rail system of an object routing system in accordance with the present invention does not require an edge against which the objects are referenced. These conventional systems rely upon the reference edge to enable coins to be sorted based upon their relative sizes. By contrast, the rail system in accordance with the present invention avoids this necessity by identifying a characteristic of the objects using a sensor. The sensor is not limited to determining the size of an object and the rail does not need a reference edge.

Figure 12:
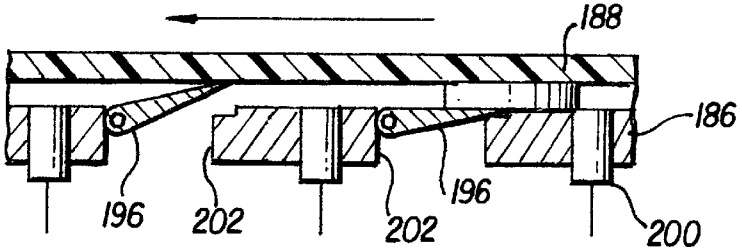
FIG. 12 is an elevational cross-sectional view of the coin routing system of FIG. 11 taken along line XII—XII.

FIG. 12 shows an elevational cross-section of the coin routing system 164 taken along line XII—XII. The rail 186 includes an array of passages 202. Each of the passages 202 is covered by a corresponding U-shaped plate 196. The processor controls whether a U-shaped plate 196 is positioned upward to provide access to the passage or is positioned downward to close the opening. In summary, the processor controls the routing for each individual coin based upon the signals from the sensor 182 and the sensors 200. The processor may be programmed to route the coins in accordance with any given function and is not limited by the physical characteristics of the coin routing system 164 in the manner of routing the coins.

Figure 13:
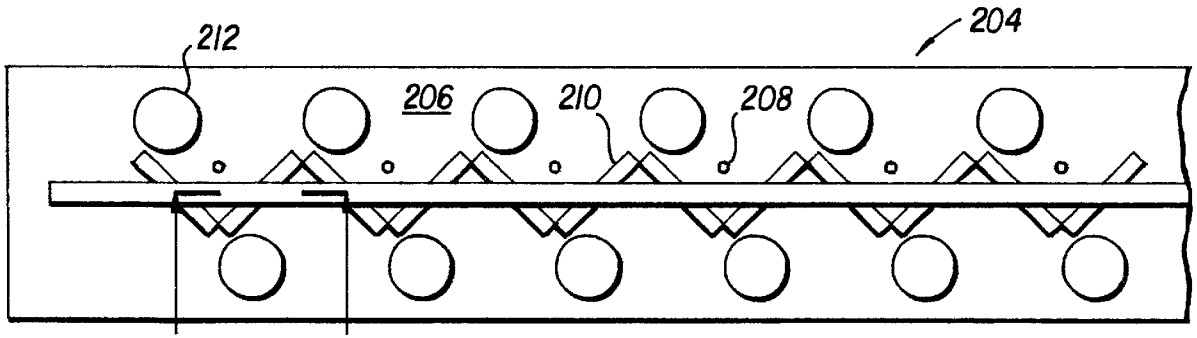
FIG. 13 is a plan view of a rail system of yet another exemplary embodiment of an object routing system that is a coin routing system in accordance with the present invention.

FIG. 13 shows a portion of yet another exemplary embodiment of an object routing system in accordance with the present invention. In particular, FIG. 13 shows a modification of the rail system of the coin routing system 164 of FIG. 1. The rail system 204 includes a rail 206, an array of sensors 208, an array of pop-up guides 210 and an array of passages 212. As explained above, with respect to FIG. 11, coins are driven along the rail 206 with a belt 214. The pop-up guides 210 are arranged along the length of the rail 206 in a manner such that when each pop-up guide 210 operates to guide a coin into a corresponding passage 212. The processor (not shown) receives signals from a sensor 182 and from the array of sensors 208 and based upon these signals the processor controls the pop-up guides 210.

Figure 14:
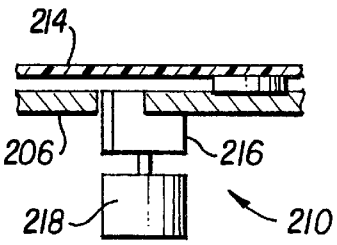
FIG. 14 is an elevational cross-sectional view of the rail system of FIG. 13 taken along line XIV—XIV.

FIG. 14 is an elevational cross-section of the rail system 204 of FIG. 13. As shown in FIG. 14, each pop-up guide 210 includes a guide wall 216 that is connected to a solenoid 218. The guide wall 216 is biased to remain below the top surface of the rail 206 to allow unimpeded passage of coins. The solenoid 218 may be energized in accordance with a command from the processor to cause the guide wall 216 to "pop-up" or extend above the surface of the rail 206 to deflect a coin(s) into an associated passage 212.

Figure 15:
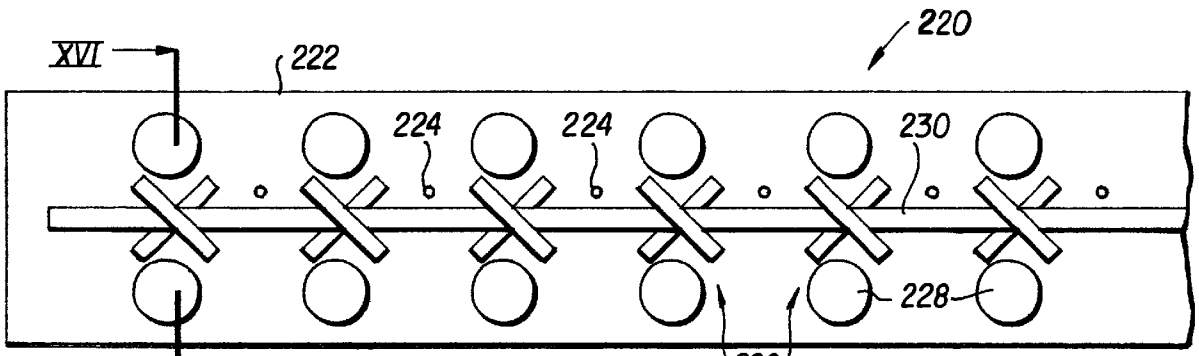
FIG. 15 is a plan view of a rail system of another exemplary embodiment of an object routing system that is a coin routing system in accordance with the present invention.
Figure 16:
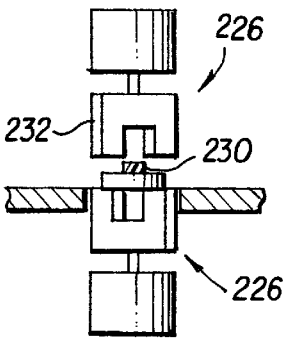
FIG. 16 is an elevational cross-sectional view of the rail system of FIG. 17 taken along line XVI—XVI.

FIG. 15 shows a portion of a modification of the rail system 204 shown in FIGS. 13 and 14. Similar to that shown in FIG. 13, rail system 220 includes a rail 222, an array of sensors 224, an array of pop-guides 226 and an array of passages 228. However, the pop-up guides 226 are arranged differently. As shown in FIG. 16, the pop-up guides 226 are arranged both above and below the belt 230. The pop-up guides 226 that are positioned below the belt 230 are identical to the pop-up guides 210 shown in FIGS. 13 and 14. However, the pop-up guides that are arranged above the belt are actually "pop-down" guides and include U-shaped guides 232. The U-shaped guides 232 are U-shaped so that each leg of the "U" extends below the belt 230 to guide a coin(s) into the corresponding passage 228.

Although the rail systems shown in FIGS. 11–16 are linear it is to be appreciated that a rail system could be curved, bent and the like and still be an object routing system in accordance with the present invention.

While this invention has been described in conjunction with the specific embodiments outlined above, it is evident that many alternatives, modifications and variations are apparent to those skilled in the art. Accordingly, the preferred embodiments of the invention as set forth above are intended to be illustrative and not limiting. Various changes may be made without departing from the spirit and scope of this invention.

What is claimed is:

1. An object routing system comprising:

an assembly having at least two object paths;

a sensor connected to said assembly that generates a signal that indicates a characteristic of an object moving through said assembly;

a processor in communication with said sensor to generate a control signal based upon the signal from said sensor; and a guide that is responsive to said control signal to route said object through one of said at least two object paths; wherein the assembly is a rotating disk assembly comprising, a centrally disposed drive shaft operatively connected to a drive motor;

a substantially cylindrical deposit tray for receiving said objects disposed about said drive shaft;

a lower disk and an upper disk attached to said lower disk, said upper disk cooperating with said lower disk to define a passage; and an intermediate annular ring sandwiched between an outer periphery of said lower disk and said upper disk to define said at least two object paths, wherein the at least two object paths extend from said passage.

2. The object routing system of claim 1, wherein at least one of the upper surface of said lower disk and the upper surface of said intermediate annular ring include protrusions.

3. The object routing system of claim 1, wherein said rotating disk assembly comprises a plurality of intermediate annular rings defining at least three object paths and wherein said guide is responsive to said control signal to route said object from said passage through one of said at least three object paths.

4. The object routing system of claim 3, wherein said guide comprises:

a first guide system that is responsive to said control signal to perform a first routing; and a second guide system that is responsive to said control signal to perform a second routing, said first routing of said object determining which guide in said second guide system will perform said second routing and said second routing placing said object into one of said at least three object paths.

* * * * *